United States Patent [19]

Rushing et al.

[11] Patent Number: 4,965,636

[45] Date of Patent: Oct. 23, 1990

[54] ELECTROSTATOGRAPHIC MACHINE WITH SCREENING

[75] Inventors: Allen J. Rushing, Webster; Donald J. Clar, Jr., N. Chili; Walter B. Sherwood, Rochester, all of N.Y.

[73] Assignee: Eastman Kodak Company, Rochester, N.Y.

[21] Appl. No.: 352,238

[22] Filed: May 15, 1989

[51] Int. Cl.[5] ..... G03G 15/22; G03G 15/32

[52] U.S. Cl. ..... 355/239; 355/211

[58] Field of Search ..... 355/239, 220, 211, 77; 430/55, 31

[56] References Cited

U.S. PATENT DOCUMENTS 3,985,432 10/1976 Hou et al. .
4,044,671 8/1977 Hou et al. .
4,168,974 9/1979 Ando et al. .
4,262,075 4/1981 Noda et al. .
4,335,194 6/1982 Sakai .
4,494,856 1/1985 Aoki et al. .

FOREIGN PATENT DOCUMENTS 60-113252 6/1985 Japan ..... 355/239

*Primary Examiner*—R. L. Moses
*Attorney, Agent, or Firm*—Milton S. Sales

[57] ABSTRACT

Each region of a photoconductive member receives an electrostatic charge over a predetermined time period. An electrostatic latent half-tone pattern image is screened on the photoconductive member such that exposure of the photoconductive member to a light pattern of a continuous tone original document will form a half-tone latent image on the photoconductive member. The screened image is formed during the predetermined time period that each region of the photoconductive member is being charged such that the half-tone pattern is partially charged over.

5 Claims, 1 Drawing Sheet

ELECTROSTATOGRAPHIC MACHINE WITH SCREENING

TECHNICAL FIELD

The present invention relates to electrophotographic reproduction apparatus and methods and, more specifically, to the improved reproduction of originals having continuous-tone, half-tone, uniform background, and/or line-type content.

BACKGROUND ART

In electrophotographic reproduction apparatus, it is desirable to reproduce continuous-tone information as half-tone images. It may also be desirable to reproduce other information, such as logos having large printed areas, with a screen to enhance reproduction made therefrom. To accomplish this, the original may be imaged through a half-tone screen onto a preassigned image frame area of an electrostatically charged photoconductive member and the resulting latent image developed with electroscopic toners which are then transferred to a copy sheet. See for example, U.S. Pat. No. 4,472,047, filed in the name of Michael D. Stoudt and issued Sept. 18, 1984, While such a procedure is satisfactory for some applications, projecting a screened light image generally does not result in clearly resolvable screen elements. Thus contact screening and integral screening have been used; see U.S. Pat. No. 3,627,526, which issued to P. J. Donald on Dec. 4, 1971,and No. 4,740,818, which issued to Tsilibes et al on Apr. 26, 1988. However, when a half-tone original is imaged onto a sharp half-tone screen pattern, a Moiré pattern is normally produced.

DISCLOSURE OF THE INVENTION

It is an object of the present invention to suppress the Moiré pattern while retaining the advantages of integral screen exposure.

It is another object of the present invention to provide improved utilization of space around the photoconductive member.

In accordance with the above objects, the present invention provides means for forming an electrostatic latent half-tone pattern image on a photoconductive member and means for partially charging over the image thus formed before image-wise exposure.

In a preferred form, the present invention includes a photoconductive member, charging means for applying an electrostatic charge to each region of the photoconductive member over a predetermined time period, and screening means for forming an electrostatic latent half-tone pattern image on the photoconductive member such that exposure of the photoconductive member to a light pattern of a continuous tone original document will form a half-tone latent image on the photoconductive member. The screening means form the half-tone pattern image during the predetermined time period that each region of the photoconductive member is being charged such that the half-tone pattern is partially charged over.

Preferably the charging means is a primary charger for sensitizing the photoconductor, and the means for forming the half-tone pattern image comprise an optical screen having a multiplicity of alternating discrete optically transparent and opaque areas. The photoconductor is moveable along a predetermined path, and the charging means is a multiple-wire corona charger extending along the movement path of the photoconductor such that each region of the photoconductor passes successively from wire to wire. The screening means is positioned intermediate the first and last corona wire encountered by each region of the photoconductor.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Figure 1:
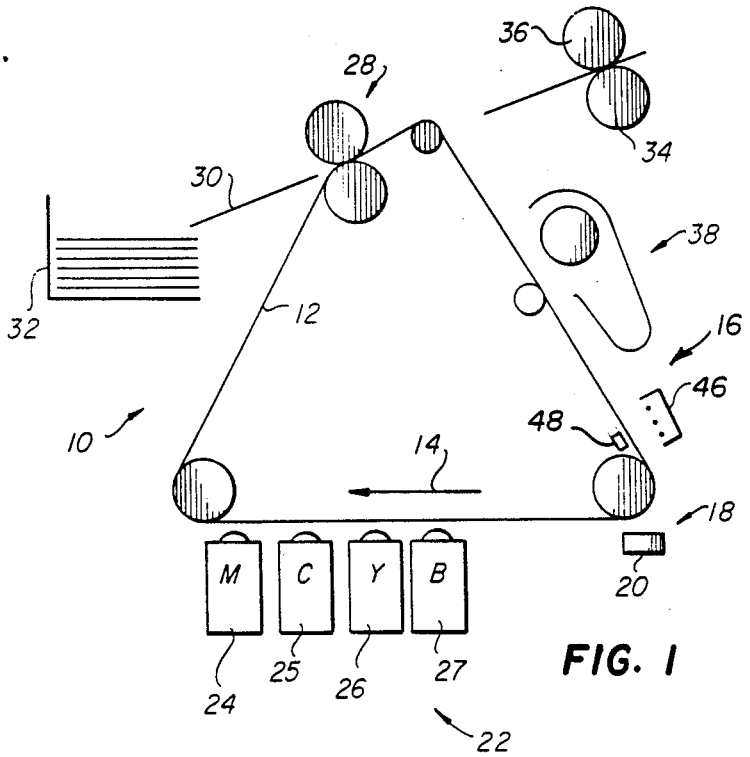
FIG. 1 is a schematic side elevational view of an electrostatographic machine suitable for the present invention.

Referring to FIG. 1, an electrostatographic machine 10 has an image transfer member such as photoconductive belt 12. Belt 12 is moved in a clockwise direction, as represented by arrow 14.

A primary charging station 16 applies an electrostatic charge to belt 12. At an exposure station 18, projected light from a write head 20 dissipates the electrostatic charge on the photoconductive belt to form a latent electrostatic image corresponding to the image of an original to be copied or printed. Write head 20 preferably has an array of light emitting diodes for exposing the photoconductive belt.

The latent electrostatic image on belt 12 is develoed with toner at a developer station 22. The developer station is illustrated as having four separate substations 24, 25, 26 and 27 for processing color images; the substations containing magenta, cyan, yellow, and black toner, respectively. Although four-color capability is illustrated, the present invention is applicable also to monochromatic images.

As the toner image on belt 12 approaches a transfer station 28, an image receiver sheet 30 is fed from a supply 32. After transfer of the toner image to the receiver sheet, the receiver sheet is passed through a pair of heated fuser rollers 34 and 36. Mechanical and electrical cleaning of belt 12 is effected at a cleaning station 38.

Figure 2:
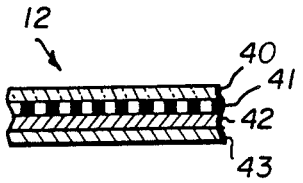
FIG. 2 is a schematic illustration in cross-section of some of the elements forming a multi-layered photoconductive member for use in the apparatus of FIG. 1.

With reference to FIG. 2, photoconductive belt 12 comprises a transparent support 40, a half-tone screen 41, a conductive layer 42, and a photoconductive layer 43. For a more complete description of web 12 and its screen, see U.S. Pat. No. 4,294,536, which issued to K. Paxton on Oct. 13, 1981.

Figure 3:
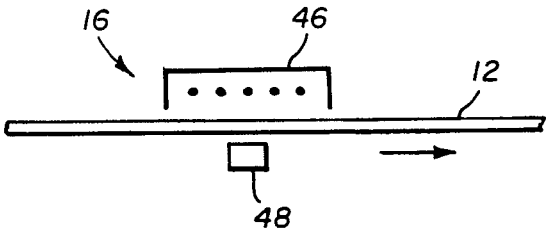
FIG. 3 is an enlarged view of the charging station of the apparatus of FIG. 1

FIG. 3 is an enlarged view of primary charging station 16 of FIG. 1. Photoconductive belt 12 passes between a multi-wire corona primary charger 46 and a light source such as an electroluminescent panel 48.

Corona primary charger 46 sensitizes photoconductive layer 43 of belt 12 by applying an electrostatic charge to the surface. Generally, the output of such chargers is controlled by a grid (not shown) connected to a programmable power supply for adjusting the primary voltage $V_o$ (also known as the "initial" voltage) in accordance with a designated set value.

Formation of a plurality of charge islands on photoconductive layer 43 of belt 12 is affected by an exposure through the rear of the web and through integral half-tone screen 41 formed in the web. This rear exposure is carried out prior to image exposure of the photoconductor by activation of electroluminescent panel 48. Thus, a latent electrostatic image of screen 41 incorporated within the photoconductive web is imaged upon charged photoconductive layer 43 substantially in the area of the image from upon which the continuous tone image is to appear.

Conventionally it has been accepted that screening must be carried out after primary charging and prior to development (see U.S. Pat. No. 4,740,818, col. 7, lines 25–27). However, in accordance with the present invention, the screening, using an electroluminescent panel and an integral screen in the illustrated embodiment, is in fact conducted in the region of the primary charger prior to completion of the charging process. As such, the half-tone dot pattern due to exposure through integral screen 41 in the illustrated embodiment is partially charged over, and thereby filled in.

By partially charging over and filling in the half-tone dot pattern, Moiré patterns which would resist from imaging a half-tone original document are greatly suppressed, while the advantages of the screen exposure with respect to contrast and tone scale are largely retained.

While the invention has been described with respect to one type of light source, it will be appreciated that others may be substituted for electroluminescent panel 48. Further, integral screening is but one preferred technique for producing a dot pattern on the web. A light emitting diode illumination source as described in U.S. Pat. No. 4,740,818 might be used, and laser, halogen, or mercury light sources may be substituted for the LED's with variable aperture arrays such as mechanically moveable masks or alternatively electrically actuated masks such as PLZT arrays used to control screen illumination. PLZT is an abbreviation for a lead lanthanum zirconate titanate electro-optical material whose optical properties can be changed by an electric field.

The invention has been described in detail with particular reference to preferred embodiments thereof, but it will be understood that variations and modifications can be effected within the spirit and scope of the invention.

What is claimed is:

1. In apparatus having a photoconductive member, charging means for applying an electrostatic charge to each region of the photoconductive member over a predetermined time period, and screening means for forming an electrostatic latent half-tone pattern image on the photoconductive member such that exposure of the photoconductive member to a light pattern of a continuous tone original document will form a half-tone latent image on the photoconductive member; the improvement wherein said screening means forms the half-tone pattern image during the predetermined time period that each region of the photoconductive member is being charged such that the half-tone pattern is partially charged over and filled in.

2. The improvement as defined in claim 1 wherein the charging means is a primary charger for sensitizing the photoconductor.

3. The improvement as defined in claim 1 wherein said means for forming the half-tone pattern image comprises an optical light screen having a multiplicity of alternating discrete optically transparent and opaque areas.

4. The improvement as defined in claim 1 wherein said means for forming the half-tone pattern image comprises an optical light screen integral with the photoconductor, said optical screen having a multiplicity of alternating discrete optically transparent and opaque areas.

5. The improvement as defined in claim 1 wherein:

the photoconductor is movable along a predetermined path;

the charging means is a multiple-wire corona charger extending along the movement path of the photoconductor such that each region of the photoconductor passes successively from wire to wire; and said screening means is positioned intermediate the first and last corona wire encountered by each region of the photoconductor.

* * * * *